US011261861B2

(12) United States Patent
Nafz

(10) Patent No.: US 11,261,861 B2
(45) Date of Patent: Mar. 1, 2022

(54) HYDROSTATIC PISTON MACHINE

(71) Applicant: Robert Bosch GmbH, Stuttgart (DE)

(72) Inventor: Timo Nafz, Horb (DE)

(73) Assignee: Robert Bosch GmbH, Stuttgart (DE)

( * ) Notice: Subject to any disclaimer, the term of this patent is extended or adjusted under 35 U.S.C. 154(b) by 48 days.

(21) Appl. No.: 16/585,133

(22) Filed: Sep. 27, 2019

(65) Prior Publication Data

US 2020/0132069 A1 Apr. 30, 2020

(30) Foreign Application Priority Data

Oct. 30, 2018 (DE) ..... 10 2018 218 548.4

(51) Int. Cl.
*F04B 49/12* (2006.01)
*F04B 1/295* (2020.01)
*F04B 1/22* (2006.01)

(52) U.S. Cl.
CPC ..... *F04B 49/12* (2013.01); *F04B 1/22* (2013.01); *F04B 1/295* (2013.01); *F04B 2201/1204* (2013.01)

(58) Field of Classification Search
CPC .. F04B 1/2014; F04B 1/2042; F04B 11/0016; F04B 11/0008; F04B 1/12; F04B 1/26;
(Continued)

(56) References Cited

U.S. PATENT DOCUMENTS 6,116,871 A * 9/2000 Backe ..... F04B 1/2042 417/540
2002/0108489 A1* 8/2002 Riedhammer ..... F04B 1/2042 92/70
2010/0150741 A1* 6/2010 Mehta ..... F04B 1/146 417/53

FOREIGN PATENT DOCUMENTS

DE 37 00 573 A1 7/1988
DE 42 29 544 C2 3/1993
(Continued)

OTHER PUBLICATIONS

Machine translation of DE-102013207320-A1, obtained from https://worldwide.espacenet.com/ (Year: 2021).*
(Continued)

*Primary Examiner* — Peter J Bertheaud
*Assistant Examiner* — Geoffrey S Lee
(74) *Attorney, Agent, or Firm* — Maginot, Moore & Beck LLP

(57) ABSTRACT

A hydrostatic piston machine has an adjustment element that is adjustable for varying a displacement volume, and a rotating cylinder part having a plurality of cylinder bores with pistons that are supported on the adjustment element and delimit a displacement chamber. Each displacement chamber is moved in an alternating manner by a connecting opening to overlap a low-pressure control opening situated on a low-pressure side of a stationary control part and a high-pressure control opening situated on a high-pressure side of the control part. Two switching regions are situated between the low-pressure control opening and the high-pressure control opening, the pistons changing direction at a dead center within the switching regions. The position of the adjustment element is determined from a pressure profile which is a function of the variable size of the displacement chambers in a switching region, the variable size depending on the position of the adjustment element.

18 Claims, 7 Drawing Sheets

(58) Field of Classification Search
CPC .... F04B 1/30; F04B 1/32; F04B 1/324; F04B 49/12; F04B 1/22; F04B 1/295; F04B 2201/1204; F04B 49/002; F04B 49/00; F04B 49/08; F04B 1/20; F04B 1/2035; F04B 1/2064; F04B 49/065; F04B 49/06; F04B 2205/03; F01B 3/0055; F03C 1/0655; F03C 1/0686; F03C 1/40; F03C 1/0636; F03C 1/06
See application file for complete search history.

(56) References Cited

FOREIGN PATENT DOCUMENTS

| | | | | | |
|---|---|---|---|---|---|
| DE | 37 83 912 | T2 | | 7/1993 | |
| DE | 198 18 721 | A1 | | 10/1999 | |
| DE | 19818721 | A1 | * | 10/1999 | ..... F04B 11/00 |
| DE | 198 19 960 | A1 | | 11/1999 | |
| DE | 101 43 206 | A1 | | 7/2002 | |
| DE | 10 2009 018 298 | A1 | | 10/2010 | |
| DE | 10 2012 218 883 | A1 | | 5/2013 | |
| DE | 10 2013 207 320 | A1 | | 10/2014 | |
| DE | 102013207320 | A1 | * | 10/2014 | ..... F04B 1/32 |
| FR | 3000770 | A1 | * | 7/2014 | ..... F04B 11/0016 |
| JP | 62-135674 | A | | 6/1987 | |

OTHER PUBLICATIONS

Machine translation of DE-19818721-A1, obtained from https://worldwide.espacenet.com/ (Year: 2021).*
Machine translation of FR-3000770-A1, obtained from https://translate.google.com/ (Year: 2021).*

* cited by examiner

HYDROSTATIC PISTON MACHINE

This application claims priority under 35 U.S.C. § 119 to application no. DE 10 2018 218 548.4, filed on Oct. 30, 2018 in Germany, the disclosure of which is incorporated herein by reference in its entirety.

The disclosure relates to a hydrostatic piston machine which is in particular configured as a hydrostatic axial piston machine, the displacement volume thereof being variable, and which has an adjusting element that for varying the displacement volume is adjustable, the respective position of said adjusting element being determinable, and a rotating cylinder part having a plurality of cylinder bores in which pistons that are supported on the adjusting element and within a cylinder bore delimit a displacement chamber are disposed. In operation, each displacement chamber by way of a connecting opening in an alternating manner is moved so as to overlap a low-pressure control opening, situated on a low-pressure side, of a stationary control part and a high-pressure control opening, situated on a high-pressure side, of said stationary control part on which two switching regions are situated between the low-pressure control opening and the high-pressure control opening, a piston switching the direction thereof at a dead center within said switching regions. The displacement volume herein is the quantity of a pressure medium that flows through the hydrostatic piston machine during one revolution of the rotating cylinder part.

BACKGROUND

A hydrostatic axial piston machine of the swashplate construction mode, which is adjustable in terms of the displacement volume thereof, in which the position of the swashplate and thus the displacement volume is detected with the aid of an opto-electronic, inductive, or magnetic measuring system which operates in an incremental and non-contacting manner is known from DE 198 19 960 B4.

It is known from DE 10 2009 018 298 A1 for the position of the cylinder drum and of the control plate in the case of a hydrostatic axial piston machine of the swashplate construction mode, in which the displacement volume is adjustable, to be detected with the aid of a rotary potentiometer which is activated as a function of the position of the actuating piston and thus as a function of the position of the cylinder drum.

From DE 10 2013 207 320 A1 it is known for the high pressure, also referred to as the pump pressure, in a hydrostatic axial piston machine of the swashplate construction mode, which is adjustable in terms of the displacement volume thereof, to be detected by a pressure sensor and for a closed-loop pressure control be implemented by way of the detected high-pressure and a directional valve by way of which the inflow of a pressure medium to and the outflow of said pressure medium from an actuating chamber of an adjustment device utilized for adjusting the displacement volume. As an alternative to utilizing a rotating speed sensor it is proposed in the document that the rotating speed of the hydrostatic piston machine is determined by evaluating the pulse of the pressure signal detected by the pressure sensor. The rotating speed herein results from the number of pressure pulses per unit of time divided by the number of pistons. As an alternative to detecting the position of the swashplate with the aid of a pivot angle sensor it is proposed in the document that the pressure in the actuating chamber is detected by a pressure sensor. According to the information in the document, said pressure in the case of a specific design embodiment of an adjusting device depends rather accurately on the position of the swashplate and thus on the displacement volume.

A hydrostatic radial piston machine is known from DE 37 00 573 A1, and a hydrostatic axial piston machine of the swashplate construction mode is known from DE 10 2012 218 883 A1 or DE 42 29 544 A1, which in each case have the features mentioned at the outset and additionally have a fluid volume which serves as a pre-compression volume (PCV). The term fluid volume is understood as a cavity which is filled or is to be filled with a liquid pressure medium, for example hydraulic fluid, and in which a pressure variation, based solely on the compressibility of the pressure medium, is associated with an inflow or outflow of a pressure medium.

In the case of the known axial piston machines, each displacement chamber, by way of a connecting opening that is incorporated at the end side on the cylinder drum, in an alternating manner is connectable to a kidney-shaped low-pressure control opening and a kidney-shaped high-pressure control opening that is in each case incorporated in a control plate that serves as a control part. The cylinder drum in operation slides along the end side on the control plate. The low-pressure control opening and the high-pressure control opening lie on a common pitch circle and are mutually spaced apart in the circumferential direction, on account of which two switching regions are formed. A respective piston is situated in the one switching region in the region of the inner dead center, or bottom dead center (BDC), thereof where said piston is plunged farthest into the cylinder bore thereof, and in the other switching region is situated in the region of the outer dead center, or top dead center (TDC), thereof, where said piston protrudes farthest from the cylinder bore thereof. In the case of an axial piston machine shown in FIG. 1 of DE 42 29 544 C2, a connecting line which is connected to the PCV opens out by way of a mouth into the switching region in which a respective piston is situated in the region of the BDC thereof. The PCV in turn by way of a slide valve and a throttle is connected to the high-pressure control opening, on account of which the PCV is capable of being supplied with high pressure and in the case of an open slide valve is slowly charged by way of the throttle. The mouth in the switching region, when viewed in the radial direction, lies outside the maximum diameter of the low-pressure control opening and the high-pressure control opening. The connecting opening of a respective displacement chamber that is delimited by the cylinder bore and by the piston has an opening portion which likewise lies outside the maximum diameter of the low-pressure control opening and the high-pressure control opening, so that the connecting opening can overlap with the mouth.

In a relative movement of the cylinder drum toward the control plate, the connecting opening of a respective displacement chamber sweeps the switching region comprising the mouth, on account of which the displacement chamber by way of the connecting line is connected to the PCV during a specific contact time and the pressure in the displacement chamber increases and the pressure in the PCV drops until the same pressure prevails in the displacement chamber and in the PCV. After the separation from the displacement chamber, the pressure in the PCV, on account of the inflow of a pressure medium from the high-pressure side through the throttled and valve-controlled connection, increases back to the high pressure. The pressure pulses on the high-pressure side are to be reduced on account of pre-filling the displacement chambers in this manner.

In the case of another hydrostatic axial piston machine known from DE 42 29 544 C2, the mouth of a connecting duct to the PCV lies close to the high-pressure control opening. The connecting openings have a contour such that the mouth is increasingly exposed by a connecting opening as soon as the cylinder chamber opening has departed from the low-pressure control opening and a pressure fluid is rapidly released from the PCV into the displacement chamber at a very high pressure. Thereafter, the mouth of the duct is briefly closed again. The mouth is subsequently increasingly exposed again in order for the PCV be brought back to a high pressure on account of the inflow of a pressure medium from the high-pressure control opening by way of the connecting opening.

In the case of the radial piston machine according to DE 37 00 573, the linking of the PCV to a mouth in the one switching region and to the high-pressure side corresponds to the linking of the PCV in the axial piston machine from DE 42 29 544 A1, first described further above, but with the difference that there is no slide valve present in the connection to the high-pressure side.

In the case of the axial piston machine according to DE 10 2012 218 883 A1, as in the second axial piston machine known from DE 42 29 544 A1, there is no line between the PCV and the high-pressure side—apart from the connecting line that leads directly from the switching region to the PCV.

SUMMARY

The object of the disclosure is based on detecting in a reliable and simple manner a state variable of a hydrostatic piston machine having the features set forth at the outset.

This is achieved in that in the case of a piston machine having the features mentioned at the outset the state variable is determined from a pressure profile which is a function of the variable size of the displacement chambers in a switching region, said variable size depending on the position of the adjusting element.

The position of the adjusting element can in particular be determined from the pressure profile. This determination is based on the concept that the profile of the pressure drop in a displacement chamber, or the profile of the pressure build-up in a fluid volume, should the latter be present, respectively, when a displacement chamber changes from the high-pressure control opening to the low-pressure control opening, as well as the profile of the pressure increase in a displacement chamber, or the profile of the pressure drop in a fluid volume, should the latter be present, respectively, when a displacement chamber changes from the low-pressure control opening to the high-pressure control opening, is a function of the position of the adjusting element. The size of the displacement chamber in the outer dead center and usually also at the inner dead center of a piston is dissimilar, depending on the position of the adjusting element. The size of the displacement chamber is at a maximum at the outer dead center when the adjusting element assumes a position corresponding to the maximum displacement volume and decreases along with a decrease in the displacement volume. The size of the displacement chamber is at a minimum in the inner dead center when the adjusting element assumes a position corresponding to the maximum displacement volume and increases along with a decrease in the displacement volume. The size of the displacement chamber has an effect on how the pressure varies in the displacement chamber, or in an optionally provided fluid volume, respectively, in the event of an inflow and an outflow of a pressure medium. By detecting the pressure and evaluating the different pressure variations, a conclusion pertaining to the position of the adjusting element can thus be drawn.

In principle, it is conceivable to detect directly how the pressure in a displacement chamber varies when changing between the two control openings of the control part. It is to be considered herein that the control opening at least at the front end thereof, thus at the end where a connecting opening to the control opening starts to open, is provided with a so-called fine control groove by way of which a displacement chamber is initially connected in a throttled manner to a control opening. In order for the pressure increase or the pressure drop to be detected when the displacement chambers change between the two control openings, pressure sensor by way of which the pressure in the currently changing displacement chamber is capable of being detected in at least one switching region suffices. In the case of such a solution however, there are restrictions in terms of placing the pressure sensor such that the installation space required for a piston machine according to the disclosure would be significantly enlarged under certain circumstances. The detection of pressure could also be falsified by cavitation effects in the switching region.

When each displacement chamber in a switching region after the separation from the one control opening and still prior to overlapping the other control opening by way of the mouth of a connecting line situated in the switching region is now connectable to a fluid volume, it is thus expedient for the pressure in the fluid volume be detected by a pressure sensor and for the position of the adjusting element to be determined from the pressure in the fluid volume. For example, in the case of the fluid volume being a pre-compression volume, the pressure profile in the fluid volume is easy to clarify. High pressure prevails initially in the fluid volume. When the connecting opening of a displacement chamber, once said connecting opening has departed from the low-pressure control opening, now comes to overlap the mouth of the connecting duct to the fluid volume, a pressure medium thus flows from the fluid volume into the displacement chamber. The pressure in the fluid volume drops; the pressure in the displacement chamber increases until the pressure in the displacement chamber is equal to the pressure in the fluid volume. Because of the compressibility of the pressure medium, in order for a specific pressure increase be caused, the larger the displacement chamber the more pressure medium has to flow into the displacement chamber. This means that the level at which a pressure equalization takes place is lower the larger the displacement chamber and thus the larger the displacement volume. A conclusion pertaining to the displacement volume can thus be drawn from the height of the level, thus the minimum pressure in the fluid volume, as compared to the high pressure. The high pressure herein is likewise detected by the pressure sensor. This is because a high pressure prevails in the fluid volume before the fluid volume is connected to a displacement chamber.

In order for the fluid volume to be brought back to the high pressure, a connecting opening within a specific angular range can be opened simultaneously to the fluid volume and to the high-pressure control opening. A pressure medium for building up the high pressure in this instance flows from the high-pressure control opening by way of the connecting opening and by way of the connecting line to the fluid volume.

The fluid volume throttled by way of a second connecting line can be permanently connected to the high-pressure side. It is possible for the fluid volume to be fed by way of this connecting line as an alternative to the connection by way of the connecting opening of a displacement chamber, or in addition to the connection by way of the connecting opening from the high pressure. It is prevented by throttling that a high pressure always prevails in the fluid volume.

For determining the position of the adjusting element and thus for determining the displacement volume, a large spread between the minimum pressures in the fluid volume at the minimum displacement volumes and at the maximum displacement volumes is advantageous. The larger the spread, the better the resolution and thus the accuracy of the measuring signal. A good resolution is obtained when the ratio between the size of the fluid volume and the maximum size of a displacement chamber in a position of the adjusting element corresponding to the maximum displacement volume is in the range between 0.3 and 3. A very good resolution is obtained when the ratio between the size of the fluid volume and the maximum size of a displacement chamber in a position of the adjusting element corresponding to the maximum displacement volume is at least approximately 0.7.

The resolution and the accuracy by way of which the displacement volume can be indicated also depends on the dead volume of a displacement chamber. The dead volume here is understood to be the available volume which a displacement chamber comprises, including the connecting opening, in the inner dead center of a piston at a position of the adjusting element corresponding to the maximum displacement volume. The smaller said dead volume the better the resolution and the accuracy. It is therefore advantageous for the pistons to be configured without a cavity that is open toward the displacement chamber. In order for the pistons to be lightweight, said pistons may readily have a cavity. However, said cavity in this instance is not open toward the displacement chamber. A fluid path that leads through a piston and by way of which lubricating oil from the displacement chamber makes its way to a bearing face of the piston or of a sliding block is not to be understood as a cavity herein.

It is particularly advantageous when the available displacement chamber remaining up to the control part in the inner dead center in a position of the adjusting element corresponding to the maximum displacement volume is at least approximately zero.

The rotating speed of the hydrostatic piston machine can be determined from the frequency at which identical or similar pressure profiles succeed one another. The high pressure can be determined from the maximum strength of the signal emitted by a pressure sensor. It is thus possible for the substantial state variables and control variables, specifically the displacement volume, the rotating speed, and the high pressure, of a hydrostatic piston machine to be determined by a simple pressure sensor. In addition to the pressure sensor, an electric evaluation unit, for example a microcontroller, which determines the parameters from the measured pressure signal is present.

BRIEF DESCRIPTION OF THE DRAWINGS

Two exemplary embodiments of a hydrostatic piston machine according to the disclosure, configured as an axial piston machine, will be explained in more detail hereunder by means of drawings in which.

DETAILED DESCRIPTION

Figure 1:
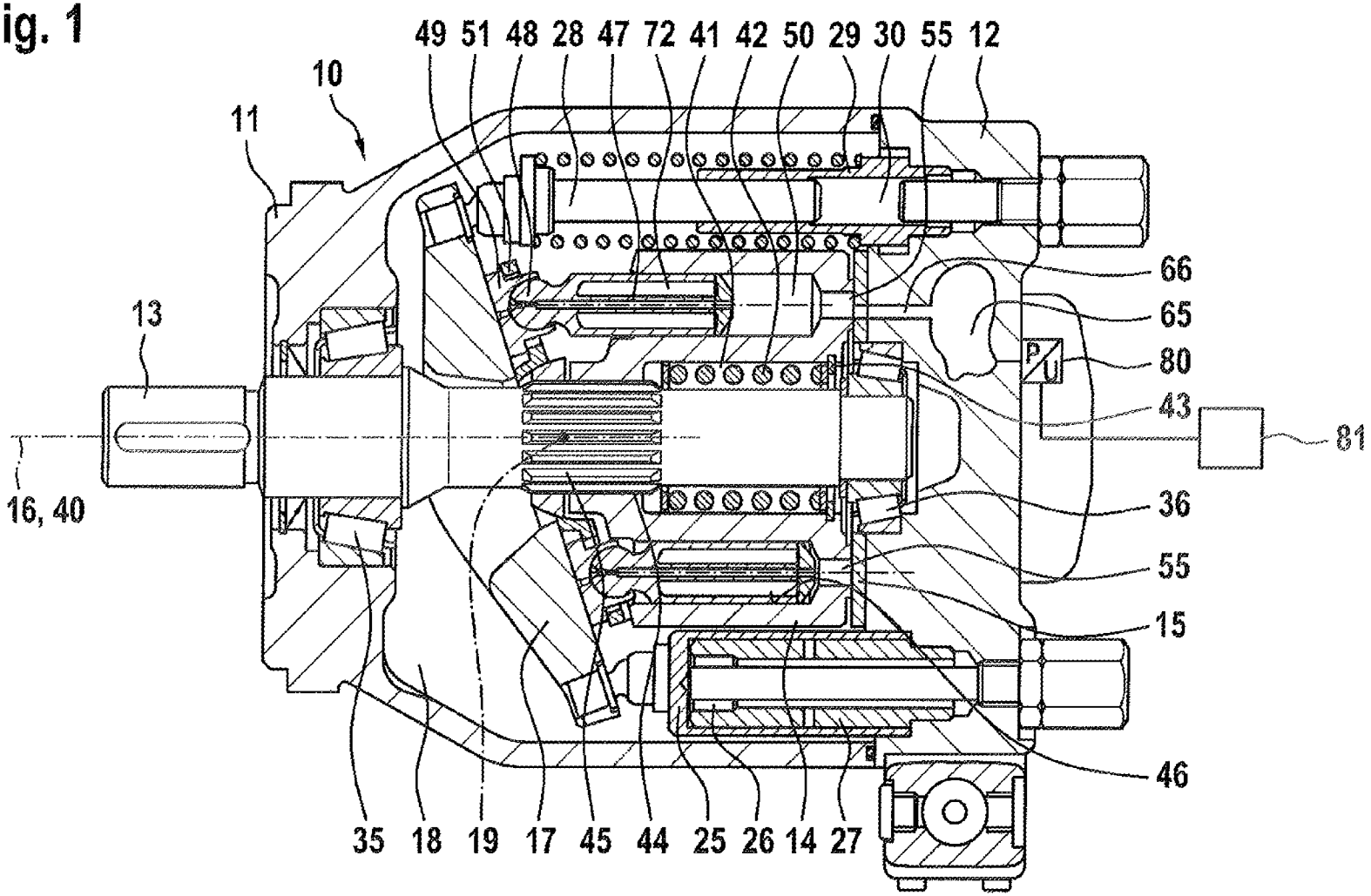
FIG. 1 shows a longitudinal section through the first exemplary embodiment.

The hydrostatic axial piston machine as per FIG. 1, as an axial piston pump that is adjustable in the displacement volume thereof, is provided for supplying one or a plurality of hydraulic consumers such as, for example, hydraulic cylinders, with a fluid medium in an open hydraulic circuit. Said hydrostatic axial piston machine is embodied in the swashplate construction mode. An open hydraulic circuit means that the axial piston pump suctions a pressure medium from a tank by way of a suction connector and by way of a pressure connector dispenses said pressure medium to the hydraulic consumers, and that the pressure medium flowing away from the hydraulic consumers flows back into the tank. The volumetric flow of the axial piston pump is proportional to the driving rotating speed and to the displacement volume which is the quantity of pressure medium conveyed per revolution.

The hydrostatic axial piston pump shown comprises a housing 10 having a pot-type housing part 11 and having a connector plate 12 in which the operational connectors are configured and by way of which the open end of the housing part 11 is closed. The axial piston pump furthermore comprises a drive shaft 13, a cylinder drum 14 as a cylinder part, a control disc 15 as a control part which is a control plate that is separate from the connector plate 12 and is disposed between the cylinder drum 14 and the connector plate 12 and is stationary relative to the connector plate, as well as a pivot cradle 17 as an adjusting element which in terms of the inclination thereof is adjustable in relation to the rotation axis 16 of the driveshaft 13. Said pivot cradle 17 can be pivoted between a position in which said pivot cradle 17 is almost perpendicular to the axis of the driveshaft 12 and which is referred to as the zero position, and a position of a maximum pivot angle shown in FIG. 1. The cylinder drum 14, the control plate 15, and the pivot cradle 17 are received by the interior space 18 of the housing part 11.

The pivot cradle 17 is centrically mounted. The pivot axis 19 of the pivot cradle thus intersects perpendicularly the rotation axis 16 of the driveshaft 13. A cup-shaped actuating piston 25 which delimits an actuator chamber 26 which by way of a control valve (not shown in more detail) can be fed a pressure liquid and from which pressure liquid can be displaced by way of the control valve is present for pivoting the pivot cradle in the one direction. The actuating piston 25 is mounted externally on a hollow cylinder 27 which is inserted in the connector plate 12, the inner part of said hollow cylinder 27 being the actuator chamber 26.

In order for the pivot cradle 17 be adjusted in the opposite direction, a counter piston 28 which is mounted internally in a hollow cylinder 29 that is inserted in the connector plate 12 and is contiguous to an actuator chamber 30, and a coil compression spring 31 which surrounds the hollow cylinder 29 and the counter piston 28 and by virtue of which the pivot cradle 17 is pivoted to a maximum when no pressures prevail in the actuator chambers, are present. The pressure from the pressure connector of the pump prevails in each case in the actuator chamber 30. However, since the effective face of the counter piston 28 is smaller than the effective face of the actuating piston 25, the pivot cradle 17 can be pivoted by the actuating piston 25 counter to the forces that are exerted on the pivot cradle by the coil compression spring 31 and by the counter piston 28.

The driveshaft 13 by way of tapered roller bearings 35 and 36 is mounted in the base of the housing part 11 and in the connector plate 12 so as to be rotatable about the rotation axis 16 and engages in a centered manner through a central breakthrough of the cylinder drum 14. Said cylinder drum 14 is connected to the driveshaft 13 in a rotationally fixed manner but so as to be axially movable and can therefore bear on the control plate 15 in a clearance-free manner.

The cylinder drum 14 is substantially a circular-cylindrical body having a central axis 40. Said cylinder drum 14 possesses a central cavity 41 which is continuous in the direction of the central axis, the drive shaft 13 running therethrough. A coil compression spring 42 which surrounds the driveshaft 13 and which by way of one end thereof is supported on a securing ring 43 that is inserted in the cylinder drum 14 and by way of the other end thereof is ultimately supported on the swashplate 17 and pushes the cylinder drum against the control plate 15 is accommodated in the central cavity 41. The cylinder drum 14 in the region of a drum neck which has a reduced external diameter and projects in the direction toward the pivot cradle 17 is internally provided with a toothing 44 which engages in a corresponding toothing 45 of the driveshaft 13. The cylinder drum 14, by way of the toothings, is connected to the driveshaft 13 in a rotationally fixed manner but so as to be axially movable. By virtue of the axial mobility, the cylinder drum 14 can be pushed onto the control disc 15 by the coil compression spring 42 in a clearance-free manner.

A plurality of, for example nine, cylinder chambers 46 which are circular-cylindrical in the cross section and lie on the same pitch circle and run parallel to the central axis 40 which coincides with the rotation axis 16 of the driveshaft 13 are incorporated in the cylinder drum 14 so as to be uniformly distributed across the circumference. The cylinder chambers, because of the circular-cylindrical cross section thereof, are referred to as cylinder bores hereunder, even when said cylinder bores are not produced from the solid material by boring or solely by boring. One piston 47 is received and guided in the longitudinal direction by each cylinder bore 46.

The pistons 47, on the end facing the pivot cradle 17, have a spherical head 48 which captively plunges into a corresponding recess of a sliding block 49 such that a ball joint is formed between the piston and the sliding block. The pistons 47 are supported on the pivot cradle 17 by means of the sliding blocks 49 such that said pistons 47 in operation carry out a stroke movement in the cylinder bores 46. The size of the stroke herein is determined by the inclination of the pivotable pivot cradle 17. Each piston 47 within a cylinder bore 46 delimits a displacement chamber 15, the volume thereof varying with the movement of the piston 47, and the maximum volume thereof and the minimum volume thereof being a function of the position of the pivot cradle 17.

In order for the pistons 47 not be lifted from the pivot cradle 17 but to remain on the pivot cradle also during the so-called suction stroke, a retraction plate 51 which in a manner known by way of various components (not referred to in more detail) is stressed by the coil compression spring 42 in the direction toward the pivot cradle is provided. The second end of the coil compression spring 42 is thus supported inter alia by way of the retraction plate 15 and the sliding blocks 49 on the pivot cradle 17 and thus not only ensures that the cylinder drum 14 is pushed onto the control plate 15 even in the absence of an operating pressure but also ensures that the pistons 47 during the suction stroke are retracted from the cylinder bores 47 and the sliding blocks 49 remain on the pivot cradle 17.

As is derived from FIGS. 2 to 6, the cylinder bores 46 and thus the displacement chambers 50 on the end side of the cylinder drum 14 that faces the control plate 15 open out into elongate connecting openings 55 which are usually curved. The width of a connecting opening 55 in the radial direction is smaller than the diameter of a cylinder bore.

The cylinder drum 14 by way of the end side having the connecting opening 55 bears on the control plate 15 and in operation slides across the control plate. The control plate possesses two kidney-shaped control openings 56 and 57 which are situated on the same pitch circle as the connecting opening 55 and of which presently the control opening 56 serves as a high-pressure control opening in which in operation a high pressure (for example a pressure of 200 bar) prevails, and the control opening 57 serves as a low-pressure control opening in which in operation a low pressure (for example a pressure of less than 5 bar), in particular the tank pressure, prevails. Between the high-pressure control opening 56 and the low-pressure control opening 57 on the control plate are two switching regions, specifically a switching region 58 in which the connecting openings 55 change from an open fluidic connection to the low-pressure control opening 57 to an open fluidic connection to the high-pressure control opening 56, and a switching region 59 in which the connecting openings 55 change from an open fluidic connection to the high-pressure control opening 56 to an open fluidic connection to the low-pressure control opening 57.

The dead centers in the stroke movement of the pistons, in which the pistons are plunged farthest into a cylinder bore (inner dead center) or protrude farthest from a cylinder bore (outer dead center) also lie within the two switching regions. Presently, the outer dead center lies in the switching region 58, and the inner dead center lies in the switching region 59.

A piston 47 is shown in the outer dead center, and a second piston 47 is shown in the inner dead center in FIG. 1. The illustration is chosen thus for clarity, even when in the case of an odd number of pistons and in the case of an identical angular spacing between the pistons, a piston cannot be situated in the outer dead center simultaneously while a second piston is situated in the inner dead center.

The control plate 15 bears in a rotationally secured manner on a connector plate 12 of the axial piston pump, wherein a high-pressure duct 60 and a low-pressure duct 61 which lead from an external side of the connector plate to the end side of the connector plate that faces the control plate and which on this end side have a cross-sectional shape that corresponds to the control openings 56 and 57 in the control plate and are at least largely congruent with the control openings are configured in the connector plate.

In order for pressure peaks in the displacement chambers 50, a non-uniform flow and pressure pulses in the high-pressure control opening 56 and thus in the high-pressure connector of the axial piston pump and in the entire hydraulic system within which the axial piston pump is used to be minimized when switching from the low-pressure control opening 57 to the high-pressure control opening 56, a fluid volume 65 of a defined size which is configured as a cavity in the connector plate 12 and from which a bore 66 which passes through the connector plate 12 and the control plate 15 and has a mouth 67 into the switching region 56 emanates is provided. The mouth 67 after a dead center of the pistons 47 is situated closer to the high-pressure control opening 56 than to the low-pressure control opening 57. The bore 66 has a certain throttling effect, this being symbolized by the throttle 68.

Figure 2:
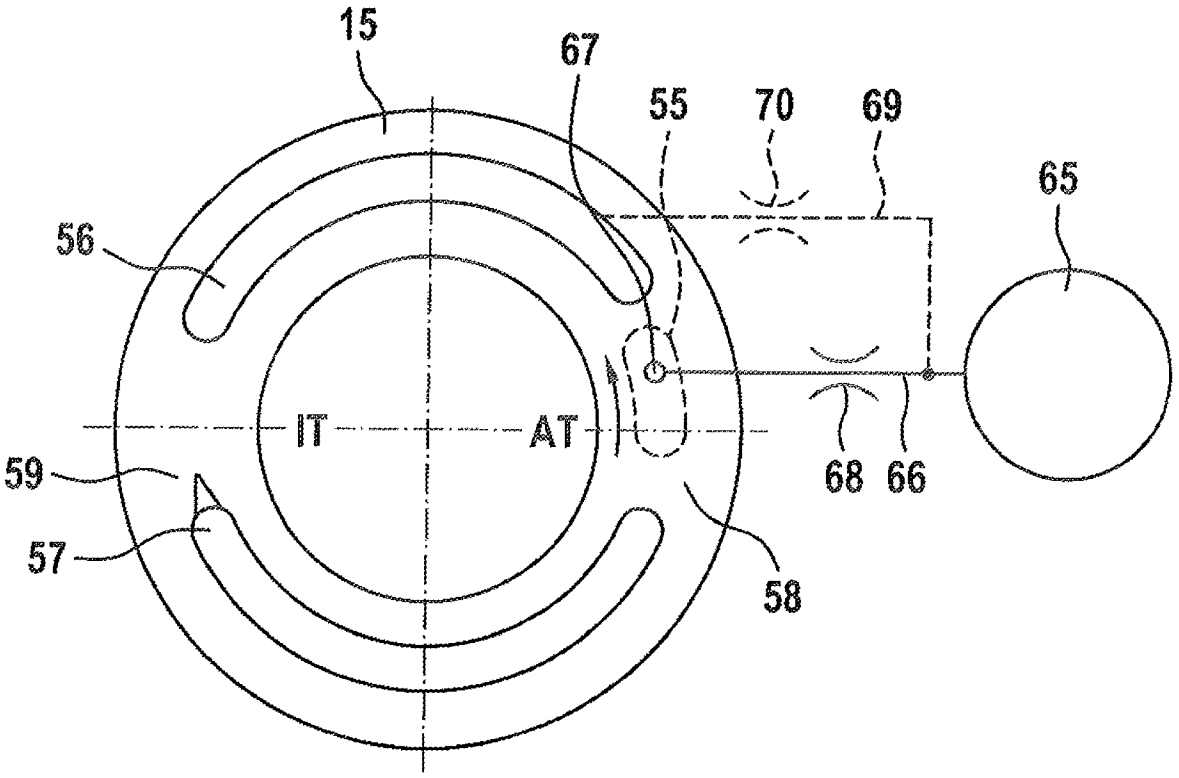
FIG. 2 shows a plan view of the control plate of the first exemplary embodiment.
Figure 3:
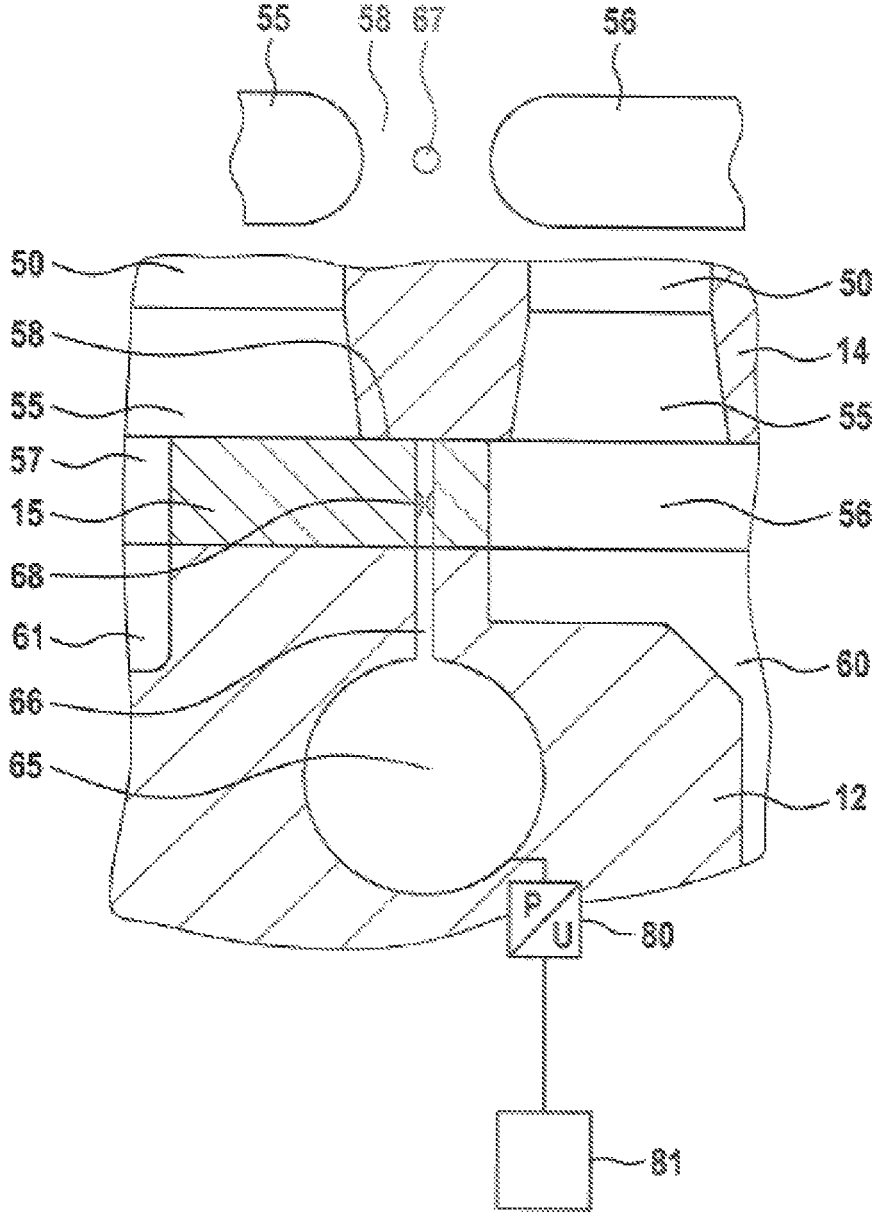
FIG. 3 shows a schematic plan view of a switching region of the control plate, and in a section in the circumferential direction shows the cylinder drum, the control plate, and the connector plate of the exemplary embodiment, wherein the cylinder drum assumes a specific position in relation to the control plate and the axial piston machine is in the pumping operation.

Optionally, the fluid volume can additionally also be fed directly from the high-pressure side of the pump. This is indicated in FIG. 2 by a line 69 which is illustrated in dashed manner and in which a throttle 70 is disposed or which acts as a throttle.

A pressure sensor 80 which emits an electric signal that depends on the pressure in the fluid volume to an electronic evaluation unit 81 is connected to the fluid volume 65.

In operation, switching of the connecting openings 55 from the low-pressure control opening 57 to the high-pressure control opening 56 takes place in the switching region 58. The volume of the displacement chamber 50 in a cylinder bore 46, thus the volume of a cylinder bore including the connecting opening 55 which is not occupied by the material of the respective piston 47, herein is large since the respective piston is situated close to or in the outer dead center thereof. The displacement chamber is even of maximum size since the pivot cradle 17 is pivoted to the maximum. The volume of the displacement chamber 50 is at a minimum in the zero position of the pivot cradle 17, at which the pistons 47 do not perform any movement. The difference between the maximum volume and the volume of a displacement chamber 50 which is still present in the case of a pivot cradle pivoted to the maximum, when a piston 47 is situated at the inner dead center thereof, is referred to as the dead volume here. The difference between the maximum volume of a displacement chamber 50 and the dead volume is the maximum displacement volume per piston which results from the cross-sectional face of a piston and the stroke thereof in the case of a pivot cradle pivoted to the maximum. In the operation of the pump, the connecting openings 55 move across the control openings 56 and 57 and the switching regions 58 and 59. In the illustration as per FIG. 3, a connecting opening 55 is still open toward the low-pressure control opening 57. The tank pressure prevails in the respective displacement chamber 50. The high pressure prevails in the fluid volume 65. Said high pressure is detected by the pressure sensor 80 and is transmitted as an electric signal to the evaluation unit 81. The height of the high pressure is stored in the evaluation unit 81.

Figure 4:
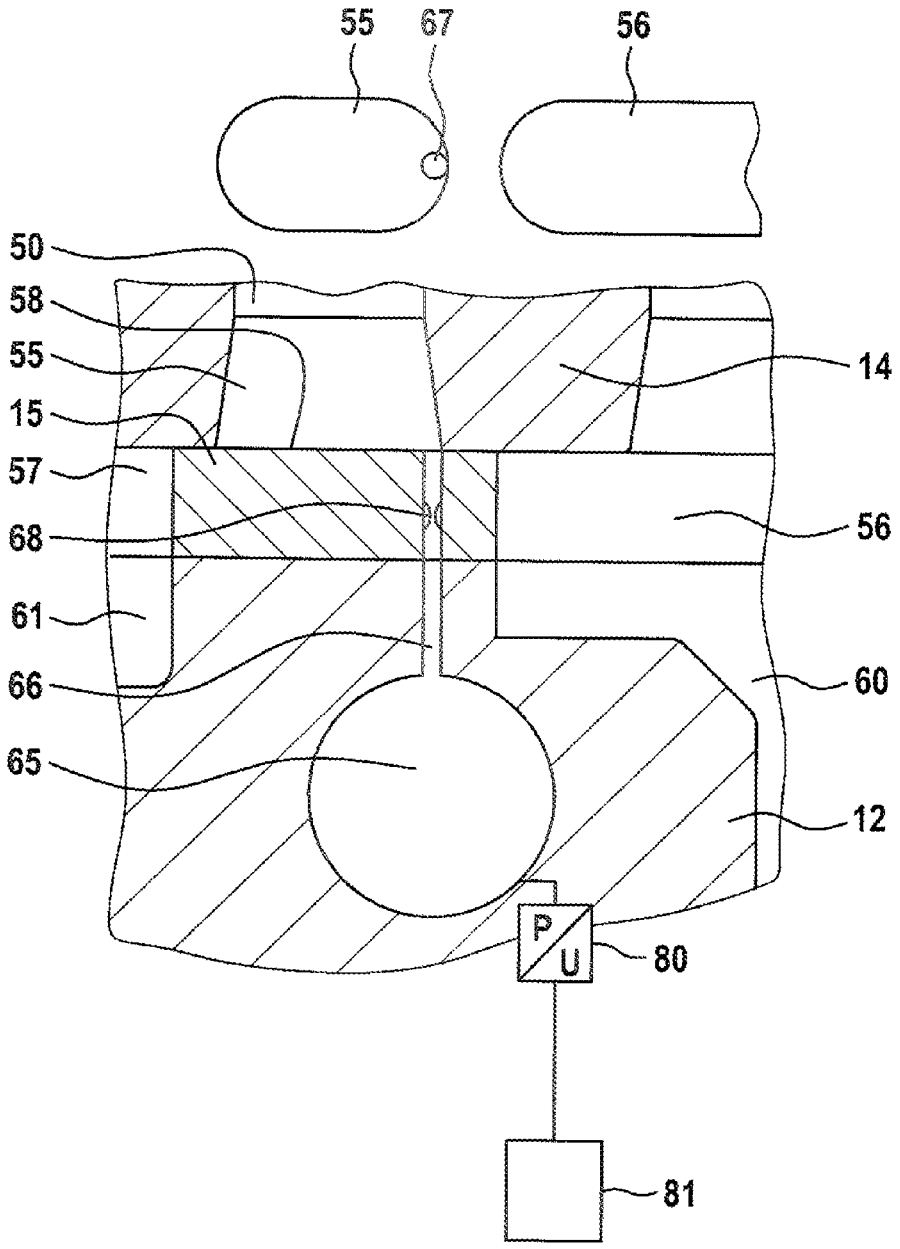
FIG. 4 shows the same plan view and the same section as in FIG. 3 in the case of a cylinder drum that has been further rotated.

Upon further rotation of the cylinder drum 14, the connecting opening 55 departs from the low-pressure control opening 57 and comes to overlap the mouth 67 of the bore 66 so that a fluidic connection is established between the displacement chamber 50 and the fluid volume 65 (see FIG. 4). A pressure fluid now flows from the fluid volume 65 into the displacement chamber 50 so that the pressure in the displacement chamber 50 increases and the pressure in the fluid volume 65 drops. The inflow of pressure fluid into the displacement chamber 50 ends when the same pressure prevails in the displacement chamber 50 as in the fluid volume 65. The pressure which prevails in the pressure equalization between the displacement chamber 50 and the fluid volume 65 is also reported to the evaluation unit 81 by the pressure sensor 80 which continuously transmits pressure values to the evaluation unit. The pressure at which a pressure equalization is established herein is a function of the size of the displacement chamber 50 and thus of the position of the piston 47 and of the position of the pivot cradle 17. The smaller the stroke of the piston, the smaller the displacement chamber 50 when sweeping the switching region 56 and the higher the pressure at which a pressure equalization has taken place between the displacement chamber 50 and the fluid volume 65. The pressure at which the pressure equalization has taken place moreover depends directly on the high pressure. The ratio between the minimum pressure in the fluid volume and the high pressure is now formed in the evaluation unit 81 and the position of the pivot cradle 17 is derived therefrom.

Figure 5:
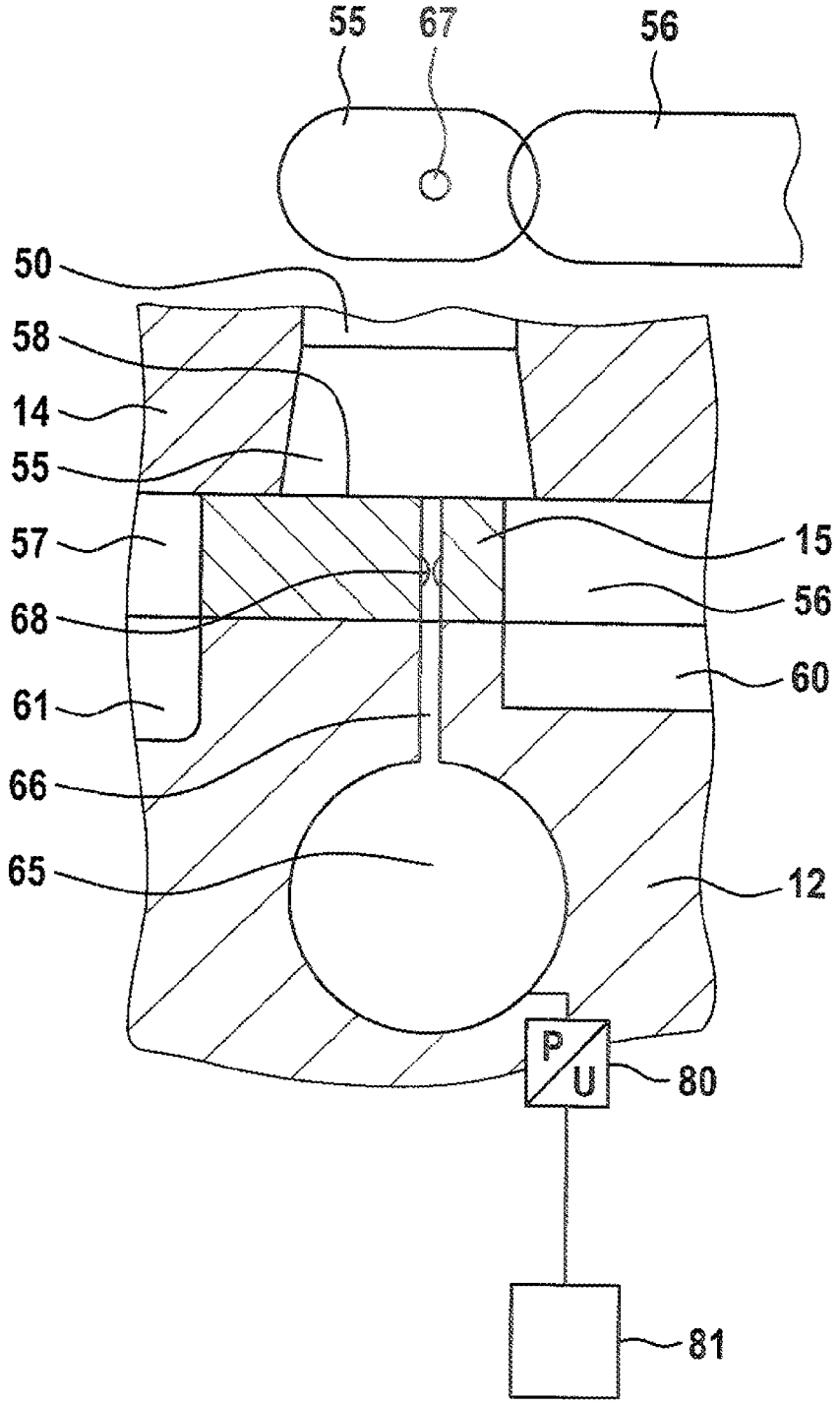
FIG. 5 shows the same plan view and the same section as in FIG. 4 in the case of a cylinder drum that has been further rotated.

Upon further rotation of the cylinder drum 14 the connecting opening 55 reaches the high-pressure control opening 56 and increasingly overlaps the latter (see FIG. 5). On account thereof, not only is a fluidic connection between the high-pressure control opening 56 and the displacement chamber 50 achieved, but also between the high-pressure control opening 56 and the fluid volume 65, so that a pressure fluid now flows from the high-pressure control opening 56 into the fluid volume 65. When the connecting opening 55 no longer overlaps the bore 66, the high pressure prevails again in the fluid volume 65, said high pressure in turn being identified as such by the evaluation unit 81 and being able to be resorted to for controlling or regulating the pump or other hydraulic components.

The evaluation unit also establishes how large the respective temporal interval between two pressure drops or between two minimum pressures or between twice achieving the high pressure in the fluid volume is. Said evaluation unit determines therefrom the rotating speed of the pump in that the reciprocal value of the temporal interval is divided by the number of pistons.

In the case of a hydrostatic piston machine according to the disclosure, a simple pressure sensor which measures the pressure in the PCV thus suffices in order for the substantial state variables and control variables of the piston machine to be determined. While a pump has been described above as an exemplary embodiment, the disclosure can also be implemented in hydrostatic piston machines which are designed as motors or are provided for the operation as pumps and motors.

Figure 6:
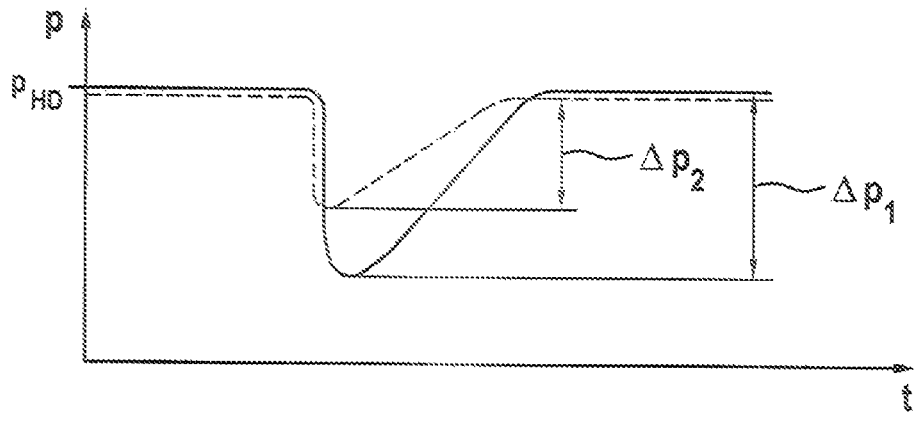
FIG. 6 shows a diagram in which two pressure profiles in a PCV are shown.

Two pressure profiles in the fluid volume 65 for different pivot angles of the pivot cradle 17 are shown in the diagram as per FIG. 6. The pressure profile in the case of a large pivot angle is illustrated by a solid line, and the pressure profile in the case of a smaller pivot angle is illustrated by a dashed line. It can be seen that the difference $\Delta p1$ between the high pressure and the minimum pressure in the fluid volume for a large pivot angle is greater than the difference $\Delta p2$ for a smaller pivot angle.

In order for the pivot angle of the axial piston pump according to FIGS. 1 to 5 to be determined, or for determining the position of the adjusting element of a hydrostatic piston machine in general, a large spread between the measured minimum pressures at full stroke and zero stroke is advantageous. It has been established that it is advantageous in terms of a large spread for the dead volume to be as small as possible. The dead volume on the piston which has just reached the inner dead center thereof can be readily seen in the case of the axial piston pump as per FIG. 1. The pistons 47 are indeed configured as hollow pistons with a view to a light weight and to saving material. However, the cavity 72 in said pistons is closed toward the cylinder bore so that the volume of the cavity is not included in the dead volume.

Figure 7:
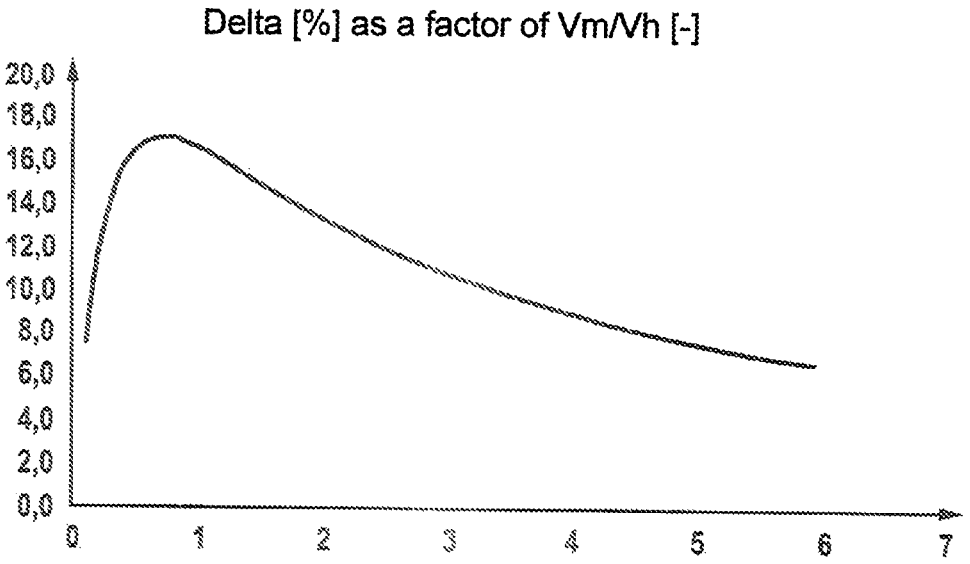
FIG. 7 shows a diagram for resolving the measurement.

The difference Delta, standardized for the high pressure, between the minimum pressure in the fluid volume at a maximum displacement volume and the minimum pressure in the fluid volume at a maximum displacement volume is plotted as a function of the ratio between the size of the fluid volume Vm and the maximum displacement volume per piston Vh (displacement volume of a piston at the maximum pivot angle of the pivot cradle) in FIG. 7. It can be seen that Delta is at a maximum at Vm/Vh equal to 0.7, for instance, but a good resolution is even achieved at Vm/Vh between 0.3 and 3. Larger values for Vm/Vh are also possible. However, the resolution is poorer in this instance.

Figure 8:
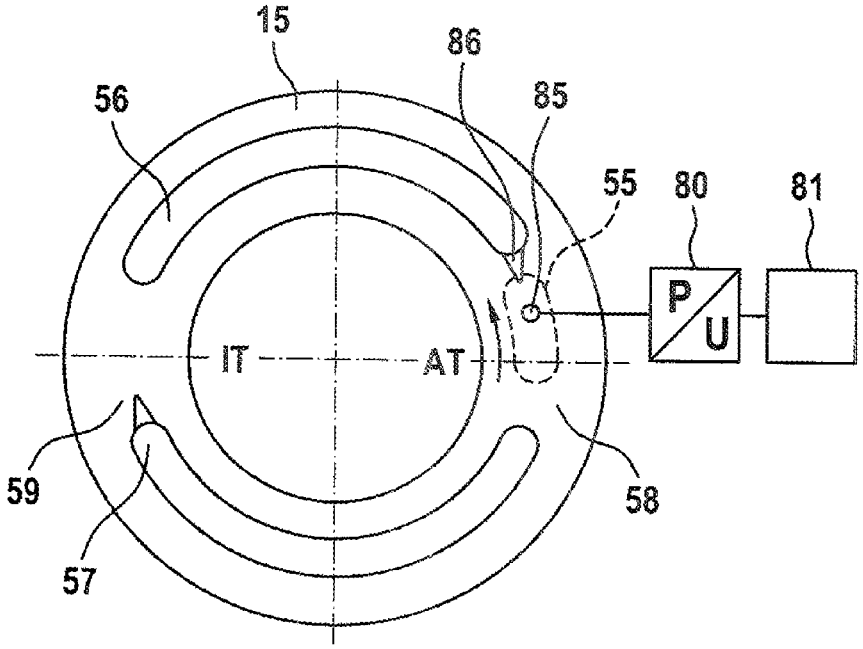
FIG. 8 shows a plan view of the control plate of a second exemplary embodiment.

No pre-compression volume is provided for the hydrostatic axial piston pump of which the control plate 15 is shown in FIG. 8. The pressure increase such as takes place in a displacement chamber 50 when changing from the low-pressure control opening 57 to the high-pressure control opening 58 is measured by the pressure sensor 80 directly by way of a bore 85 in the region of the switching region 58, and said pressure increase is reported to the electronic evaluation unit 81. The displacement chamber herein, after the separation from the low-pressure control opening 57, is initially fluidically connected to the high-pressure control opening 56 so as to be throttled by way of a fine control groove 86. Depending on the volume of the displacement chamber which in turn is a function of the position of the pivot cradle 17, and depending on the high pressure, dissimilar pressure increases result in the displacement chamber, a conclusion pertaining to the position of the pivot cradle being able to be drawn from said dissimilar pressure increases.

LIST OF REFERENCE SIGNS

10 Housing
11 Pot-type housing part
12 Connector plate
13 Driveshaft
14 Cylinder drum
15 Control plate
16 Rotation axis of 13
17 Pivot cradle
18 Interior space of 11
19 Pivot axis of 17
25 Actuating piston
26 Actuator chamber
27 Hollow cylinder
28 Counter piston
29 Hollow cylinder
30 Actuator chamber
35 Tapered roller bearing
36 Tapered roller bearing
40 Central axis of 14
41 Cavity in 14
42 Coil compression spring
43 Securing ring
44 Toothing on 14
45 Toothing on 13
46 Cylinder bores
47 Piston
48 Head on 47
49 Sliding block
50 Displacement chamber
51 Retraction plate
55 Connecting openings
56 High-pressure control opening
57 Low-pressure control opening
58 Switching region
59 Switching region
60 High-pressure duct in 12
61 Low-pressure duct in 12
65 Fluid volume
66 Bore
67 Mouth of 66
68 Throttle
72 Cavity in 47
80 Pressure sensor
81 Electric evaluation unit
85 Bore
86 Fine control groove

The invention claimed is:

1. A hydrostatic piston machine, which has a variable displacement volume, comprising:

an adjustment element that is adjustable to vary the displacement volume, a position of the adjustment element being determinable; and a rotating cylinder part defining a plurality of cylinder bores, each of which includes a respective piston that is supported on the adjustment element and delimits a respective displacement chamber, wherein each respective displacement chamber includes a respective connecting opening which is moved so as to overlap, in an alternating manner, a low-pressure control opening, which is situated on a low-pressure side of a stationary control part, and a high-pressure control opening, which is situated on a high-pressure side of the stationary control part, wherein two switching regions are situated on the stationary control part between the low-pressure control opening and the high-pressure control opening, the pistons switching direction at a dead center within the two switching regions, wherein an electric evaluation unit of the hydrostatic piston machine is configured to determine a state variable of the piston machine from a pressure profile in a first switching region of the two switching regions, and wherein the pressure profile is a function of the variable size of the respective displacement chambers, the variable size depending on the position of the adjustment element.

2. The hydrostatic piston machine according to claim 1, wherein the state variable is the position of the adjustment element.

3. The hydrostatic piston machine according to claim 1, wherein:

each respective displacement chamber is configured to be connectable to a fixed fluid volume cavity via a mouth of a first connecting line situated in the first switching region at a rotational angle of the rotating cylinder part whereat the respective connecting opening of the respective displacement chamber does not overlap the low-pressure control opening or the high-pressure control opening.

4. The hydrostatic piston machine according to claim 3, further comprising:

an electric pressure sensor configured to sense a pressure in the fixed fluid volume cavity, wherein:

the state variable is a position of the adjustment element; and the pressure profile is determined from the pressure in the fixed fluid volume cavity.

5. The hydrostatic piston machine according to claim 4, wherein:

the respective displacement chambers move from the low-pressure control opening to the high-pressure control opening through the first switching region, the pressure in the fixed fluid volume cavity is a high pressure prior to connecting each of the respective displacement chambers to the fixed fluid volume cavity such that while connecting the fixed fluid volume cavity and each of the respective displacement chambers, the pressure in the fixed fluid volume cavity drops to a minimum pressure, and the position of the adjustment element is determined from a ratio between the minimum pressure and the high pressure.

6. The hydrostatic piston machine according to claim 3, wherein each respective connecting opening is open simultaneously to the fixed fluid volume cavity and to the high-pressure control opening within a specific angular range of the rotating cylinder part such that pressurized fluid for building up high pressure flows from the high-pressure control opening by way of the respective connecting opening and by way of the first connecting line to the fixed fluid volume cavity.

7. The hydrostatic piston machine according to claim 3, wherein the fixed fluid volume cavity is permanently connected to the high-pressure side by a throttled second connecting line.

8. The hydrostatic piston machine according to claim 3, wherein a ratio between a size of the fixed fluid volume cavity and a maximum size of the respective displacement chamber, in a position of the adjustment element corresponding to a maximum displacement volume, is between 0.3 and 3.

9. The hydrostatic piston machine according to claim 8, wherein the ratio between the size of the fixed fluid volume cavity and the maximum size of the respective displacement chamber, in the position of the adjustment element corresponding to the maximum displacement volume, is at least approximately 0.7.

10. The hydrostatic piston machine according to claim 1, wherein each respective piston is configured without a cavity that is open toward the respective displacement chamber.

11. The hydrostatic piston machine according to claim 1, wherein an available volume of the respective displacement chamber remaining up to the stationary control part in an inner dead center of the piston, in a position of the adjustment element corresponding to a maximum displacement volume, is zero.

12. The hydrostatic piston machine according to claim 1, further comprising:

an electric pressure sensor arranged in the first switching region and configured to detect a pressure in the respective displacement chamber when the connecting opening of the respective displacement chamber is aligned with the first switching region.

13. The hydrostatic piston machine according to claim 1, wherein a rotating speed of the hydrostatic piston machine is determined from a frequency at which identical or similar pressure profiles succeed one another.

14. The hydrostatic piston machine according to claim 1, wherein a high pressure is determined from a maximum strength of a signal emitted by a pressure sensor.

15. The hydrostatic piston machine according to claim 1, wherein the electric evaluation unit is configured to determine the displacement volume of the hydrostatic piston machine as the state variable.

16. The hydrostatic piston machine according to claim 1, wherein the electric evaluation unit is further configured to determine at least one of a rotating speed of the hydrostatic piston machine and a high pressure.

17. The hydrostatic piston machine according to claim 1, wherein the hydrostatic piston machine is configured as a hydrostatic axial piston machine.

18. A hydrostatic piston machine, which has a variable displacement volume, comprising:

an adjustment element that is adjustable to vary the displacement volume, a position of the adjustment element being determinable; and a rotating cylinder part defining a plurality of cylinder bores, each of which includes a respective piston that is supported on the adjustment element and delimits a respective displacement chamber, wherein each respective displacement chamber includes a respective connecting opening which is moved in an alternating manner so as to overlap a low-pressure control opening, which is situated on a low-pressure side of a stationary control part, and a high-pressure control opening, which is situated on a high-pressure side of the stationary control part, wherein two switching regions are situated on the stationary control part between the low-pressure control opening and the high-pressure control opening, the respective pistons switching direction at a dead center within the two switching regions, an electric evaluation unit of the hydrostatic piston machine is configured to determine a state variable of the piston machine from a pressure profile in a first switching region of the two switching regions, the pressure profile is a function of the variable size of the respective displacement chambers, the variable size depending on the position of the adjustment element, each respective displacement chamber is connectable to a fixed fluid volume cavity via a mouth of a first connecting line situated in the first switching region, the fixed fluid volume cavity is permanently connected to the high-pressure side by a second connecting line that is throttled, and the state variable is a rotating speed of the hydrostatic piston machine which is determined from a frequency at which identical or similar pressure profiles succeed one another.

* * * * *